US006743307B1

(12) United States Patent
Engl et al.

(10) Patent No.: US 6,743,307 B1
(45) Date of Patent: Jun. 1, 2004

(54) HIGH RESISTANCE STEEL BAND OR SHEET AND METHOD FOR THE PRODUCTION THEREOF

(75) Inventors: Bernhard Engl, Dortmund (DE); Thomas Gerber, Dortmund (DE); Klaus Horn, Dortmund (DE)

(73) Assignee: Thyssen Krupp Stahl AG, Dusseldorf (DE)

( * ) Notice: Subject to any disclaimer, the term of this patent is extended or adjusted under 35 U.S.C. 154(b) by 0 days.

(21) Appl. No.: 10/048,772

(22) PCT Filed: Jul. 31, 2000

(86) PCT No.: PCT/EP00/07377

§ 371 (c)(1),
(2), (4) Date: Jun. 24, 2002

(87) PCT Pub. No.: WO01/09396

PCT Pub. Date: Feb. 8, 2001

(30) Foreign Application Priority Data

Jul. 31, 1999 (DE) ..... 199 36 151

(51) Int. Cl.[7] ..... C21D 8/02; C22C 38/28; C22C 38/32

(52) U.S. Cl. ..... 148/333; 148/652; 148/654; 148/661; 148/533; 428/659

(58) Field of Search ..... 148/333, 652, 148/654, 661, 533; 420/104; 428/659

(56) References Cited

U.S. PATENT DOCUMENTS

| | | | | |
|---|---|---|---|---|
| 4,336,080 A | | 6/1982 | Nakaoka et al. | |
| 6,312,536 B1 | * | 11/2001 | Omiya et al. | 148/320 |

FOREIGN PATENT DOCUMENTS

| | | | |
|---|---|---|---|
| DE | 30 07 560 | A1 | 9/1981 |
| JP | 57126924 | A | 8/1982 |
| JP | 04268016 | A | 9/1992 |
| JP | 08311561 | A | 11/1996 |
| WO | WO 98/41664 | A | 9/1998 |

* cited by examiner

*Primary Examiner*—Deborah Yee
(74) *Attorney, Agent, or Firm*—Proskauer Rose LLP

(57) ABSTRACT

The invention relates to a higher-strength steel strip or steel sheet comprising a predominantly ferritic-martensitic microstructure with a martensite content of between 4 and 20%, wherein the steel strip or steel sheet, apart from Fe and impurities due to smelting, comprises (in % by weight) 0.05–0.2% C, ≦1.0% Si, 0.8–2.0% Mn, ≦0.1% P, ≦0.015% S, 0.02–0.4% Al, ≦0.005% N, 0.25–1.0% Cr, 0.002–0.01% B. Preferably the martensite content is approximately 5% to 20% of the predominantly martensitic-ferritic microstructure. Such a higher-strength steel strip or steel sheet made from a dual phase steel comprises good mechanical/technological properties even after being subjected to an annealing process which includes an overageing treatment. Furthermore, the invention relates to a method for producing steel strip or steel sheet according to the invention.

12 Claims, No Drawings

HIGH RESISTANCE STEEL BAND OR SHEET AND METHOD FOR THE PRODUCTION THEREOF

BACKGROUND OF THE INVENTION

The invention relates to a higher-strength steel strip or steel sheet comprising a predominantly ferritic-martensitic microstructure, as well as to a method for its production.

Within the context of the use of steel strip and steel sheet of the type mentioned above, there are increasingly demanding requirements in respect to their versatility, useability and service properties. Thus, continually improved mechanical characteristics of such steel strip and steel sheet are demanded. This relates in particular to the forming properties of such materials.

A steel strip or steel sheet with good forming properties is characterised by high r-values which represent good deep drawing properties, high n-values which represent good stretch forming properties, and high strain values which indicate positive plane-strain properties. A low yield strength ratio, calculated from the ratio of yield strength and tensile strength, is also characteristic of good stretch forming properties.

The general requirement for increased strength includes increased efforts in the area of lightweight construction. In this field, sheets of reduced thicknesses are used so as to save weight. The loss of strength which is associated with lightweight design, can be compensated for by an increase in the strength of the sheet itself. However, any increase in strength naturally results in a decrease in forming properties. It is thus the prime objective of further improvements in materials of the type discussed in this instance, to increase the strength while at the same time keep the decrease in forming properties as low as possible.

The steel-iron materials sheets 093 and 094 list numerous higher-strength micro-alloyed or P-alloyed steels with good cold formability. Some of these steels have bake-hardening characteristics. These characteristics can in particular be achieved by applying a continuous annealing process which if needed is linked with a hot dip refining process.

In addition, in practical application successful attempts have been made to increase the strength of steels while at the same time achieving significantly better forming properties, by increasing the alloy contents. By way of a supplement or an alternative, it has been possible to improve these characteristics with higher cooling rates during the hot roll process or the continuous annealing process. However, this approach is associated with a disadvantage in that the increased contents of alloying elements and the installation and operation of the required cooling equipment result in increased costs.

Conventional continuous annealing plants for sheet comprise an overageing furnace behind the annealing and cooling parts. In such an overageing zone, "overageing" of the steel strip or steel sheet occurs in that the processed steel strip or steel sheet is kept within a temperature range of ≦500° C. In the case of low-alloyed, soft steels, such holding at a temperature of up to 500° C. causes extensive precipitation of dissolved carbon as carbide. As a result of this precipitation of carbide, the mechanical/technological properties of the steel strip or steel sheet are positively influenced. However, in the production of dual phase steels in continuous annealing plants, undesirable tempering effects in the martensite can occur during the passage through the overageing zone.

SUMMARY OF THE INVENTION

It is thus the object of the invention to create a higher-strength steel strip or steel sheet made from a dual-phase steel, said steel strip or steel sheet comprising good mechanical/technological properties even after being subjected to an annealing process which includes an overageing treatment. Furthermore, a method for producing such strip or sheet is to be disclosed.

This object is met by a higher-strength steel strip or steel sheet comprising a predominantly ferritic-martensitic microstructure with a martensite content of between 4 and 20%, wherein the steel strip or steel sheet, apart from Fe and impurities due to smelting, comprises (in % by weight) 0.05–0.2% C, ≦1.0% Si, 0.8–2.0% Mn, ≦0.1% P, ≦0.015% S, 0.02–0.4% Al, ≦0.005% N, 0.25–1.0% Cr, 0.002–0.01% B. Preferably the martensite content is approximately 5% to 20% of the predominantly martensitic-ferritic microstructure.

A steel strip or steel sheet according to the invention features high strength of at least 500 N/mm$^2$ while at the same time featuring good forming properties, without there being a need for particularly high contents of particular alloying elements. In order to increase strength, the invention makes use of the transformation-influencing effect of the element boron, such effect being already known per se in the case of steels for hot rolled strip and forged pieces. In this, the strength-increasing effect of boron is ensured in that according to the invention at least one alternative nitride former, preferably Al and as a supplement Ti, is added to the steel material. The effect of adding titanium and aluminium consists of their binding the nitrogen present in the steel, so that boron is available to form hardness-increasing carbides. Supported by the necessarily present Cr content, in this way a higher level of strength is achieved when compared to comparative steels of conventional compositions.

As mentioned, the strength-increasing effect of boron in steels has already been discussed in the state of the art in the context of producing hot strip or forged pieces. Thus the German published application DE 197 19 546 A1 describes for example a hot strip of the highest strength, with optionally Ti being added by alloying, to said hot strip, in a quantity which is sufficient for a stoichiometrical fixation of the nitrogen present in the steel. In this way, the quantity of boron which has also been added, is protected against fixation to nitrogen. The boron can thus contribute without hindrance to increasing the strength and the through-hardenability of the steel. Furthermore, the German published application DE 30 07 560 A1 describes the production of a higher-strength hot-rolled dual-phase steel to which boron in quantities of 0.0005 to 0.01 weight % is added. In this case, boron is added to delay the ferrite-pearlite transformation.

Surprisingly, it has been shown that in the case of a higher-strength steel strip or steel sheet according to the invention, the quantity of martensite remains, even if after cold rolling, the respective material is subjected to an annealing treatment with subsequent cooling and overageing or if it is subjected to a hot dip refining process. The yield strengths of a strip or sheet according to the invention are between 250 N/mm$^2$ and 350 N/mm$^2$. The tensile strengths are 500 N/mm$^2$ to more than 600 N/mm$^2$, in particular up to 650 N/mm$^2$. In the non-dressed state, the material is practically free of yield strength elongation ($A_{RE}$≦1.0). A steel strip or steel sheet according to the invention thus comprises properties and characteristics which it was hitherto not possible to achieve in the case of low-alloyed steels.

A further advantage of steels according to the invention, is their resistance to tempering effects. The presence of chromium in steels according to the invention, prevents the problem which in particular occurs in the case of dual-phase steels of conventional composition, namely the problem that the martensite content is tempered during overageing treatment and that in this way a decrease in strength occurs.

Preferably a steel strip or steel sheet according to the invention additionally comprises a Ti content of at least $2.8 \times A_N$, wherein $A_N$=content of N in % by weight. In this, the Al content can be limited to a range of 0.02–0.05% by weight. In this embodiment of the invention, the nitrogen contained in the steel is offered Al as a nitride former and in addition there is also a quantity of Ti present which is sufficient for the stoichiometrical nitrogen fixation. By contrast, if no Ti is present in the steel, the Al content of the steel strip or steel sheet should range between 0.1 to 0.4% by weight. Due to the presence of aluminium and/or titanium, first of all relatively large-grain TiN and/or AlN form(s) during cooling. Since titanium and aluminium have a greater affinity to nitrogen than does boron, the existing boron content is available for carbide formation. This has a more favourable effect on the mechanical properties of steels according to the invention, than is the case where, in the absence of adequate contents of titanium or aluminium, for example at first small-grained BN is precipitated.

One option of producing steel strip or steel sheet according to the invention consists of producing the steel strip or steel sheet by cold rolling a hot strip. As an alternative, it is however also possible to process a thin hot strip without further cold rolling to produce a steel strip according to the invention, provided its thickness is sufficiently reduced for further processing. Such a hot strip can for example be produced on a direct strand reduction mill in which a cast steel strand is directly rolled to a thin hot strip. Irrespective as to which method of producing the steel strip or steel sheet is selected, the above-mentioned object concerning the production method is met in that the steel strip or steel sheet is subjected to an annealing treatment in the continuous furnace during which treatment the annealing temperature is between 750° C. and 870° C., preferably between 750° C. and 850° C., and in that the annealed steel strip or steel sheet is subsequently cooled down from the annealing temperature at a cooling rate of at least 20° C./s and at most 100° C./s.

With the process according to the invention, based on a C—Mn steel to which boron and at least Al and if need be by way of a supplement Ti have been added as a nitride former, a steel strip can be produced that even at the annealing and cooling conditions stated, comprises the desired high martensite content of approximately 5% to 20%. Contrary to the conventional approach, this does not require the steel strip or steel sheet, after continuous annealing, to be cooled at a high cooling rate, so as to form martensite in the microstructure. Instead, the boron, which is freely dissolved in the lattice, ensures that martensite formation occurs even at low cooling rates such that a predominant ferrite/martensite microstructure with the property combinations which are typical for dual-phases, results. It has been found that this effect is already effective at a boron content of 0.002 to 0.005%. Thus the invention makes it possible to produce a higher-strength steel strip or steel sheet without the need for expensive devices for cooling or without the use of large quantities of alloying elements.

Furthermore it has been found that steels produced according to the invention do not experience any degradation worth mentioning, in their properties, as a result of tempering effects in the martensite, when undergoing overageing. In those cases where no hot dip refining of the steel strip or steel sheet is carried out, overageing can last up to 300 s at a treatment temperature between 300° C. and 400° C. By contrast, if hot dip refining, for example hot galvanising, does take place, then the holding period during possible overageing during galvanising should last up to 80 s, with the treatment temperature being between 420° C. and 480° C. Furthermore, the properties of a galvanised steel strip or steel sheet produced according to the invention can be further improved in that after galvanising, galvannealing treatment which is know per se, is carried out. During such treatment, hot galvanised sheet or strip is annealed after hot dipping. Depending on the particular application, it may moreover be advantageous if the steel strip or steel sheet is subsequently dressed.

DETAILED DESCRIPTION OF THE INVENTION

Below, the invention is explained in more detail with reference to embodiments.

Table 1 shows the alloying contents and the technological/mechanical characteristic values $A_{RE}$ (yield strength elongation), $R_{eL}$ (lower yield strength), $R_m$ (tensile strength), $R_{el}/R_m$ (yield strength ratio) and $A_{80}$ (elongation to fracture) for steel strip A1–A4 according to the invention. By way of comparison, the same table shows the respective information for comparison steel strip B1–B5, C1–C5, D1–D4 and E1.

In the case of all steel strip A1–E1 according to the invention, shown in Table 1, said steel strip being shown for comparison, the C content is between 0.07 and 0.08% by weight. In the case of the shown comparison steel strip B1–B5, the Mn content of 1.5–2.4% by weight has been used to influence the transformation behaviour. In the case of the comparison steel strip C1–C5, for the same purpose an element combination of Si (around 0.4% by weight) and Mn (1.5–2.4% by weight) and in the case of the comparison steel strip D1–D4 a combination of the contents of Si (up to 0.7% by weight), Mn (1.2–1.6% by weight) and Cr (0.5% by weight) have been used. In the case of the comparison steel strip E1, Mo has been provided in addition.

In the case of the steel strip A1–A4 according to the invention, apart from Si (up to 1.0% by weight) and Mn (0.8–1.5% by weight) which have also been used, the highly transformation-delaying property of boron has been taken advantage of. To prevent the formation of boron nitrides, the nitrogen was fixed with Ti as a nitride former. The Ti content present for this purpose was around 0.03% by weight in the case of N contents of 0.004 to 0.005% by weight, while the B content was approx. 0.003% by weight.

After smelting the steels A1–A4 and pouring a slab of each at a time, the respective slab was heated to 1170° C. Each heated slab was then rolled to form a hot strip with a thickness of 4.2 mm. The finishing rolling temperature ranged between 845 and 860° C. Subsequently, the hot strip was coiled at a temperature of 620° C., with the average coil cooling being 0.5° C./min. Subsequently the hot strip was pickled and cold rolled to a thickness of 1.25 mm.

The respective cold-rolled steel strip was subjected to a continuous annealing process which was guided by a standard furnace practice with overageing for low-alloyed soft steels. An annealing temperature during continuous annealing of 800° C. and a two-step cooling with final passing through the overageing zone were essential characteristics of this annealing and overageing treatment. At first, cooling was down to 550–600° C. at a cooling rate of approx. 20°

C./s. Subsequently, cooling took place at a cooling rate of approx. 50° C./s to 400° C. The subsequent overageing treatment consisted of holding the strip at a temperature range of 400–300° C. for a period of 150 s.

The mechanical/technological characteristic values shown in Table 1 for the steel strip A1 to A4 produced according to the invention, after conventional continuous annealing in the non-dressed state, document the advantageous properties of the steel strip or steel sheet produced according to the invention, when compared to the additionally shown higher-strength alloying concepts of the comparison steel strip. The fact that in the case of the steel strip according to the invention there is no yield strength elongation in the non-dressed state, clearly points to the favourable ferrite/martensite microstructure formation. The elongation limits are below 300 N/mm$^2$ and the strength values between 530 N/mm$^2$ and 630 N/mm$^2$. Thus the respective steel strip A1–A4 exhibits good hardening behaviour during plastic deformation. This also manifests itself in a very low yield strength ratio ($R_e/R_m$<0.5). In the case of strengths of 540–580 N/mm$^2$ the elongation at fracture is between 27 and 30%; in the case of approx. 630 N/mm$^2$ it is still a good 25%. On the whole, the mechanical properties are isotropic.

In a predominant number of cases, all the comparison steel strip with strengths at the level of steel strip according to the invention, exhibit less favourable strain values, above all at significantly increased values of yield strength elongation. This expresses more unfavourable hardening behaviour.

In the case of comparison steel strip a lack of yield strength elongation can only be achieved by very high Mn contents of more than 2.1% by weight (comparison steel strip B4, B5, C5). Furthermore, significantly higher strength values are found. At the same time however, less favourable yield strength ratios and smaller elongations are achieved.

Table 2 shows the alloying contents and the technological/mechanical characteristic values $A_{RE}$ (yield strength elongation), $R_{eL}$ (lower yield strength), $R_m$ (tensile strength), $R_{eL}/R_m$ (yield strength ratio) and $A_{80}$ (elongation to fracture) for steel strip F1 according to the invention. To produce the steel strip F1, first a Ti—B alloyed C—Mn steel was smelted and then hot rolled and cold rolled in the conventional way. Subsequently the cold-rolled steel strip F1 was annealed and conveyed through a hot galvanising plant.

Annealing was carried out at 870° C. This was followed by a holding phase of 60 seconds at 480° C. The temperature of the galvanising zinc bath was 460° C. Table 3 shows the details of the operating conditions. The properties of the steel strip F1 which was hot-dip refined in this way and subsequently dressed, are within the range of the properties of the strip according to the invention, whose values appear in Table 1.

Table 4 shows the alloying contents and the technological/mechanical characteristic values $A_{RE}$ (yield strength elongation), $R_{eL}$ (lower yield strength), $R_m$ (tensile strength), $R_{eL}/R_m$ (yield strength ratio) and $A_{80}$ (elongation to fracture) for steel strip $G1^1$–$G1^4$ according to the invention. Each of the steel strip $G1^1$–$G1^4$ was produced based on a steel of identical composition and was subjected to a conventional hot rolling and cold rolling process.

The cold rolled steel strip $G1^1$ and $G1^2$ were subjected to continuous annealing treatment while the steel strip $G1^3$ and $G1^4$ were subjected to hot galvanising treatment. Table 5 shows the respective operational conditions. With annealing temperatures of 780–800° C., the tensile strengths of the steel strip $G1^1$–$G1^4$ are around 500 N/mm$^2$. Commencement of creeping is largely free of yield strength elongation ($A_{RE} \leqq 1.0\%$).

TABLE 1

| Steel | C | Si | Mn | P | S | Al | N | Cr | Mo | Ti | B | $A_{Re}$ | $R_{eL}$ | $R_m$ | $R_{eL}/R$ | $A_{80}$ |
|---|---|---|---|---|---|---|---|---|---|---|---|---|---|---|---|---|
| strip | [% by weight] | | | | | | | | | | | [%] | [N/mm$^2$] | [N/mm$^2$] | [—] | [%] |
| A1 | 0.08 | 0.01 | 1.48 | 0.01 | 0.012 | 0.04 | 0.004 | 0.5 | — | 0.028 | 0.003 | 0 | 258 | 544 | 0.47 | 27 |
| A2 | 0.08 | 0.39 | 1.23 | 0.01 | 0.012 | 0.03 | 0.004 | 0.5 | — | 0.028 | 0.0032 | 0 | 252 | 531 | 0.47 | 30 |
| A3 | 0.08 | 0.79 | 1.24 | 0.009 | 0.012 | 0.03 | 0.005 | 0.51 | — | 0.029 | 0.0032 | 0 | 260 | 582 | 0.45 | 28 |
| A4 | 0.08 | 0.78 | 1.46 | 0.009 | 0.013 | 0.04 | 0.004 | 0.51 | — | 0.029 | 0.003 | 0 | 266 | 631 | 0.42 | 25 |
| B1 | 0.07 | 0.01 | 1.53 | 0.012 | 0.01 | 0.03 | 0.005 | — | — | — | — | 3.6 | 366 | 475 | 0.77 | 24 |
| B2 | 0.07 | 0.03 | 1.87 | 0.011 | 0.013 | 0.02 | 0.004 | — | — | — | — | 1.2 | 350 | 557 | 0.63 | 17 |
| B3 | 0.07 | 0.01 | 1.95 | 0.011 | 0.01 | 0.03 | 0.004 | — | — | — | — | 1.0 | 350 | 602 | 0.58 | 15 |
| B4 | 0.08 | 0.02 | 2.14 | 0.012 | 0.009 | 0.03 | 0.003 | — | — | — | — | 0 | 389 | 701 | 0.55 | 15 |
| B5 | 0.08 | 0.03 | 2.4 | 0.011 | 0.011 | 0.04 | 0.004 | — | — | — | — | 0 | 522 | 852 | 0.61 | 11 |
| C1 | 0.08 | 0.42 | 1.53 | 0.019 | 0.012 | 0.03 | 0.005 | — | — | — | — | 3.6 | 428 | 571 | 0.75 | 30 |
| C2 | 0.07 | 0.38 | 1.63 | 0.011 | 0.011 | 0.03 | 0.003 | — | — | — | — | 3.0 | 420 | 583 | 0.72 | 28 |
| C3 | 0.08 | 0.35 | 1.93 | 0.012 | 0.013 | 0.03 | 0.004 | — | — | — | — | 1.2 | 407 | 668 | 0.61 | 19 |
| C4 | 0.07 | 0.32 | 2.11 | 0.011 | 0.011 | 0.03 | 0.004 | — | — | — | — | 1.1 | 416 | 707 | 0.59 | 19 |
| C5 | 0.08 | 0.40 | 2.38 | 0.011 | 0.009 | 0.03 | 0.004 | — | — | — | — | 0 | 477 | 898 | 0.53 | 21 |
| D1 | 0.07 | 0.01 | 1.26 | 0.009 | 0.01 | 0.03 | 0.003 | 0.49 | — | — | — | 5.0 | 370 | 455 | 0.81 | 26 |
| D2 | 0.08 | 0.01 | 1.60 | 0.01 | 0.013 | 0.04 | 0.005 | 0.3 | — | — | — | 3.0 | 358 | 486 | 0.74 | 28 |
| D3 | 0.07 | 0.01 | 1.46 | 0.01 | 0.011 | 0.02 | 0.004 | 0.48 | — | — | — | 2.1 | 311 | 468 | 0.66 | 26 |
| D4 | 0.08 | 0.73 | 1.41 | 0.01 | 0.01 | 0.03 | 0.005 | 0.56 | — | — | — | 1.7 | 327 | 570 | 0.57 | 25 |
| E1 | 0.08 | 0.03 | 1.35 | 0.011 | 0.009 | 0.04 | 0.004 | 0.51 | 0.32 | — | — | 2.5 | 341 | 471 | 0.73 | 27 |

TABLE 2

| Steel | C | Si | Mn | P | S | Al | N | Cr | Mo | Ti | B | $A_{Re}$ | $R_{eL}$ | $R_m$ | $R_{eL}/R$ | $A_{80}$ |
|---|---|---|---|---|---|---|---|---|---|---|---|---|---|---|---|---|
| strip | [% by weight] | | | | | | | | | | | [%] | [N/mm$^2$] | [N/mm$^2$] | [—] | [%] |
| F1 | 0.08 | 0.04 | 1.5 | 0.013 | 0.014 | 0.06 | 0.01 | 0.52 | — | 0.029 | 0.0031 | 0 | 278 | 521 | 0.53 | 24 |

TABLE 3

| Steel strip | Preheater | Annealing furnace | Cooling zone | Nozzle | Galvanising bath | Belt speed |
|---|---|---|---|---|---|---|
| | | | [° C.] | | | [m/min] |
| F1 | 830 | 870 | 480 | 325 | 460 | 70 |

TABLE 4

| Steel strip | C | Si | Mn | P | S | Al | N | Cr | Mo | Ti | B | $A_{Re}$ | $R_{eL}$ | $R_m$ | $R_{eL}/R$ | $A_{80}$ |
|---|---|---|---|---|---|---|---|---|---|---|---|---|---|---|---|---|
| | | | | | | [% by weight] | | | | | | [%] | [N/mm²] | [N/mm²] | [—] | [%] |
| G1[1] | 0.072 | 0.09 | 1.49 | — | 0.01 | 0.103 | 0.0047 | 0.5 | — | — | 0.0045 | 0 | 241 | 521 | 0.463 | 21.7 |
| G1[2] | " | " | " | " | " | " | " | " | " | " | " | 0 | 295 | 563 | 0.524 | 15.0 |
| G1[3] | " | " | " | " | " | " | " | " | " | " | " | 0.9 | 264 | 488 | 0.541 | 27.8 |
| G1[4] | " | " | " | " | " | " | " | " | " | " | " | 0 | 267 | 515 | 0.518 | 23.1 |

TABLE 5

| Steel | Type | Annealing temperature [° C.] | Holding period [s] | Overageing [° C.] | Holding period [S] |
|---|---|---|---|---|---|
| G1[1] | Continuous annealing | 780 | 75 | 350 | 180 |
| G1[2] | Continuous annealing | 800 | 75 | 350 | 180 |
| G1[3] | Hot dipgalvanising | 780 | 75 | 460 | 60 |
| G1[4] | Hot dipgalvanising | 800 | 75 | 460 | 60 |

What is claimed is:

1. A higher strength steel strip or steel sheet comprising a predominantly ferritic-martensitic microstructure with a martensite content of between 40% and 20%, wherein the steel strip or steel sheet, apart from Fe and impurities due to smelting, comprises (in % by weight)

| | |
|---|---|
| C: | 0.05–0.2%; |
| Si: | ≦1.0; |
| Mn: | 0.8–2.0% |
| P: | ≦0.1%; |
| S: | ≦0.015%; |
| Al | 0.02–0.4%; |
| N: | ≦0.005%; |
| Cr: | 0.25–1.0%; |
| B: | 0.002–0.01%; and |

optionally Ti:

wherein for A1 contents of 0.02–0.06%, the Ti content is at least $2.8 \times A_N$, with $A_N$=content of N; and wherein the A1 content is 0.1–0.4% if there is no Ti present.

2. The steel strip or steel sheet according to claim 1, characterised in that its B content is 0.002 to 0.005% by weight.

3. A method for producing a steel strip or steel sheet according to claim 1 in which the steel strip or steel sheet is produced by cold rolling a hot strip, characterised in that the cold-rolled steel strip or steel sheet is subjected to an annealing treatment in a continuous furnace during which treatment the annealing temperature is between 750° C. and 870° C., and in that the annealed steel strip or steel sheet is subsequently cooled down from the annealing temperature at a cooling rate of at least 20° C./s and at most 100° C./s.

4. A method for producing a steel strip or steel sheet according to claim 1 in which the steel strip or steel sheet is produced by annealing a thin hot strip, characterised in that the steel strip or steel sheet as a thin hot strip is subjected to an annealing treatment in a continuous furnace during which treatment the annealing temperature is between 750° C. and 870° C., and in that the annealed steel strip or steel sheet is subsequently cooled down from the annealing temperature at a cooling rate of at least 20° C./s and at most 100° C./s.

5. The method according to claim 3, characterised in that following cooling, the continuously annealed, cooled steel strip or steel sheet is subjected to an overageing treatment in an overageing zone.

6. The method according to claim 5, characterised in that the holding period in the overageing zone is up to 300 s and a treatment temperature of 300° C. to 400° C.

7. The method according to claim 5, characterised in that following overageing, the steel strip or steel sheet is subjected to hot dip refining.

8. The method according to claim 7, characterised in that the hot dip refining step comprises a galvanizing treatment, and the treatment duration required for galvanizing and passing through the overageing zone is up to 80 s, and the treatment temperature is between 420° C. and 480° C.

9. The method according to claim 8, characterised in that after galvanizing, a galvannealing treatment is carried out.

10. The method according to claim 3, characterised in that the steel strip or steel sheet is subsequently dressed as a final step of the method.

11. The method according to claim 3 wherein the annealing temperature is between 750° C. and 850° C.

12. The method according to claim 4 wherein the annealing temperature is between 750° C. and 850° C.

* * * * *